US006533922B2

(12) United States Patent
Siskin et al.

(10) Patent No.: US 6,533,922 B2
(45) Date of Patent: Mar. 18, 2003

(54) PROCESS FOR REDUCING FOULING IN COKING PROCESSES

(75) Inventors: Michael Siskin, Randolph, NJ (US); Simon Robert Kelemen, Annandale, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/803,577

(22) Filed: Mar. 9, 2001

(65) Prior Publication Data

US 2002/0166795 A1 Nov. 14, 2002

(51) Int. Cl.[7] ..... C10G 9/12; C10G 15/00; C10G 35/00; C10B 55/00

(52) U.S. Cl. ..... 208/48 R; 208/50; 208/52 R; 208/106; 208/131

(58) Field of Search ..... 208/48 R, 50, 208/52 R, 106, 131

(56) References Cited

U.S. PATENT DOCUMENTS

| | | | | |
|---|---|---|---|---|
| 3,580,959 | A | 5/1971 | Dorner | 260/683 |
| 3,687,840 | A | 8/1972 | Sze et al. | 208/131 |
| 3,959,115 | A | 5/1976 | Hayashi et al. | 208/53 |
| 4,199,434 | A | 4/1980 | Sze et al. | 208/40 |
| 4,267,031 | A | 5/1981 | Hirabayashi et al. | 208/106 |
| 4,361,478 | A | 11/1982 | Gengler et al. | 208/130 |
| 4,797,197 | A | 1/1989 | Mallari | 208/131 |
| 4,908,121 | A | 3/1990 | Hackemesser et al. | 208/85 |

FOREIGN PATENT DOCUMENTS

| | | | |
|---|---|---|---|
| GB | 1557809 | 12/1979 | C10C/3/00 |

*Primary Examiner*—Walter D. Griffin
*Assistant Examiner*—Tam M. Nguyen
(74) *Attorney, Agent, or Firm*—Estelle C. Bakun; George B. Georgellis

(57) ABSTRACT

A process for decreasing fouling in a refinery unit comprising preheating a hydrocarbon feed to a refinery unit reactor zone and thereafter introducing the feed into the refinery unit reactor zone for reaction. The feed contains polymers and oligomers, and is preheated for a time and at a temperature sufficient such that when the feed is introduced into the refinery unit reaction zone for reaction, the combination of the pre-heating and heating attributable to the reaction zone causes at least 85% of the polymers and oligomers contained in the feed to unzip and wherein no more than about 5 wt % coke is formed in said feed during the preheating step.

9 Claims, No Drawings

PROCESS FOR REDUCING FOULING IN COKING PROCESSES

FIELD OF THE INVENTION

A preferred embodiment of the invention is directed to reducing fouling in Coking Processes.

BACKGROUND OF THE INVENTION

Fluidized bed coking (fluid coking) and FLEXICOKING are petroleum refining processes in which mixtures of heavy petroleum fractions, typically the non-distillable residue (resid) from fractionation, are converted to lighter, more useful products by thermal decomposition (coking) at elevated reaction temperatures, typically about 900 to 1100° F. (about 480 to 590° C.) by heat supplied by fluidized coke particles.

Fouling in the stripper and scrubber sections of a Coker vessel results in decreased capacity and run length of the unit, culminating in costly unplanned shutdowns.

Fluid Catalytic Cracking (FCC) is another petroleum refining conversion process in which heavy oil, typically the highest boiling distillable fraction, is converted to gasoline, diesel and jet fuel, heating oil, liquefied petroleum gas (LPG), chemical feedstocks, and refinery fuel gas by catalytic decomposition at similarly elevated temperatures of about 900 to 1100° F. (about 480 to 590° C.). Run length or capacity of an FCCU may likewise be limited by deposition of coke in the stripper, reactor overhead, plenum, nozzle, transfer line, or inlet to the fractionator.

What is needed in the art is an efficient, predictable, and effective way to mitigate the fouling tendency in the stripper, scrubber, surge drum and other sections of coking units.

SUMMARY OF THE INVENTION

An aspect of the invention is directed to a process for decreasing fouling in refinery unit reactor zones wherein said refinery unit reactor zone is run at temperatures of at least about 300° C. and wherein said feed experiences heating in said refinery unit reaction zone, comprising pre-heating the feed to said refinery unit reactor zone and thereafter introducing said feed into said refinery unit reactor zone for reaction, wherein said feed contains polymers and oligomers, and wherein said feed is pre-heated for a time and at a temperature sufficient such that when said feed is introduced into said refinery unit reaction zone for reaction, the combination of said pre-heating and heating attributable to said reaction zone causes at least 85% of said polymers and oligomers contained in said feed to unzip and wherein no more that about 5 wt % coke is formed in said feed during said heating.

The invention is particularly useful in coking and cracking refinery units.

DETAILED DESCRIPTION OF THE INVENTION

In feeds to refinery coking units, polymers and oilgomers are typically present. They are formed in petroleum feeds by thermal and thermally initiated oxidative oligomerization reactions with certain feed components and are typically present in from about 0.02 wt. % to about 5 wt. % (200 to 50,000 wppm) in the feed. Upon entering the reactor these can coat and/or thermally aklylate coke surfaces making them sticky. Sticky coke particles can agglomerate and the feed coating the coke particle surface can undergo further thermal conversion and a mesophase can form at the coke particle contact point, binding the coke particles together. The mesophase formation of the feed between the contact points of agglomeration is one mechanism leading to cementing of the coke particles that were previously held together by weaker adhesive forces. Typical feeds to coking units are comprised of many different polymers, oligomers and mixed polymers and oligomers formed with styrenes, methylstyrenes, indenes, and conjugated dienes with minor amounts of indole, carbazole, phenol, naphthol, thiophenol, thionaphthol, and the like components. The oligomers/polymers are in many cases sticky themselves and depending on their molecular weight and the refinery unit reaction temperature can tenaciously coat or alkylate coke particles with a sticky layer. This sticky layer can lead to agglomeration of the coke particles and subsequent coke formation at the contact points of agglomeration before they undergo sufficient thermal cracking conversion to reduce their stickiness via unzipping of the polymer chain.

In current coking unit operation, the feed is preheated and has an average residence time at temperature of about ten minutes. This is quite different than the feed having an actual residence time (time at temperature) of at least 5 minutes or holding the feed at temperature for at least five additional minutes once it reaches temperature. In current operations, once the feed reaches temperature, it is injected through feed nozzles into the reactor, or introduced by other means. It has been discovered that such a preheat scheme is inadequate to prevent thermal alkylation or coating of coke particles by long sticky polymeric materials and destruction of these polymeric materials on the coke particles, and hence agglomeration occurs. As a result, carryunder of the now heavier agglomerated sticky coke particles to the stripper sheds, sticking of these agglomerates to the sheds, and fouling occurs. Applicants have found that heating the feeds for an amount of time in addition to the preheat described above, prevents thermal alkylation and coating of coke particles by the highest molecular weight, most sticky polymeric materials and alkylation and coating by smaller polymeric units (oligomers) is more easily overcome by thermal decomposition reactions at the higher temperature of the coke particles in the reactor, e.g., 530° C. vs. a typical 345° C. preheat section of the reactor.

Thus, an embodiment of the invention includes preheating the feed to the refinery unit to a bulk temperature compatible with the economics of the unit and additionally continuing to pre-heat and thereafter introducing the feed into the reaction zone such that the combination of additional pre-heating and the heating which occurs due to the heating of the feed in the reaction zone causes at least 85% of the polymers and oligomers contained in the feed to unzip. The pre-heating prior to introduction into the reaction zone is conducted such that no more than about 5 wt. % coke is formed in the feed prior to introducing the feed into the reaction zone. The 85% is determined by the skilled artisan by running a TGA on the feed. The 85% includes both the amount of unzipping that occurs during pre-heating in addition to the amount of additional unzipping that would occur during the residence time of the feed in the reactor. To determine if at least about 85% unzipping has occurred, the minimum residence time of the feed in the reaction zone would be utilized in the calculation for determining the amount of unzipping. Such amounts of unzipping are readily calculatable by the skilled artisan. The feed will thus, preferably be pre-heated at a temperature of at least about 300° C. for a time sufficient to cause the polymers present in the feed which can coat and cause alkylation of coke to unzip. The pre-heating for an additional amount of time described herein may be conducted at temperatures of at least about 300° C., preferably about 300 to about 400 and most preferably about 350 to about 370° C. The feed is preferably pre-heated for residence times of at least about 5 minutes, preferably least about 10 minutes and most preferably, at least about 15 minutes. Although longer times may be utilized, it is preferable to pre-heat the feeds for a maximum time of about 1 hour, preferably about 30 minutes since longer times impact the economics of the process. The additional pre-heating is conducted such that the feed does not form more than about 5 wt. % coke particles that could precipitate and coat the pre-heat section walls and result in decreased yield of product and potentially in fouling of the preheat section. One skilled in the art will readily recognize that, e.g., for coking units, the additional pre-heating described herein, should be conducted at least at the current pre-heat temperature that the feed would be heated to prior to introduction to the unit without the additional continued pre-heating described herein. One skilled in the art will further recognize that the higher the additional pre-heating temperature, the less time required within the range described to achieve the desired effect.

Traditional pre-heat treatments are used to bring feed close to reactor temperature for heat balance purposes and not for carrying out another specific chemical reaction to circumvent reactor fouling. One skilled in the art recognizes this pre-heat treatment is carried out to ensure that the feed temperature is compatible with the economics of the process. The pre-heat vessel may be any suitable containing device, such as pipes, holding tanks, etc. that provide the required residence time. Preheat temperatures should preferably be below coking temperatures, e.g., about 400° C., preferably about 370° C. to prevent coke formation in the preheat section, but high enough to unzip the polymers. A plot for the cumulative unzipping of the pure polystyrene of MW 230,000 shows that about 10 wt. % of the polymer is unzipped every 10 minutes at 348° C. [S. L. Madorski, "The Thermal Degradation of Organic Polymers", Interscience Publishers, New York, N.Y. 1963.]

Beneficially, by preheating the feed as taught herein, the feed undergoes an additional viscosity decrease making it more susceptible to higher conversions at faster rates during the coking process because lower viscosity feeds produced by the thermal cracking reactions will form thinner and more even coatings on coke particles. Thinner coatings favor more rapid conversion to dry coke, higher product yields, better product quality and lower levels of bogging of coke particles in the fluidized bed. More even coatings prevent buildup of unconverted thick spots that form dry coke at slower rates and thereby make the coke particles more susceptible to agglomeration.

The residence or heating time required for any given feed will be that necessary for the polymers and oligomers present, or a portion thereof, to become less sticky or unzipped and depends on the extent of oligomerization that has taken place prior to the feed entering the preheat zone of the reactor where the heating is conducted. One skilled in the art can readily determine the heating times and temperatures within the constraints taught herein. For example, it is well known that a clay-gel separation can be run on a sample of the feed to isolate the amount of polymeric material contained therein. A TGA can then be run to determine the weight loss profile. Thus, one skilled in the art would be able to select the appropriate times and temperatures, from the weight loss profile, within the given ranges at which to run the process. The Table illustrates the results based on analysis of TGA data for two different samples of polymers/oligomers isolated by clay separation.

| Sample | Time (Minutes) | Extent of Reaction at 300° C. | Extent of Reaction at 330° C. | Extent of Reaction at 360° C. |
|---|---|---|---|---|
| Oligomers from T90 fraction of Heavy Catalytic Naphtha (HCN) | 30 | 15% | 50% | 97% |
| Oligomers from Heavy Coker Gas Oil (HKGO) | 30 | 34% | 93% | 100% |
| Oligomers from T90 fraction of Heavy Catalytic Naphtha (HCN) | 60 | 45% | 97% | 100% |
| Oligomers from Heavy Coker Gas Oil (HKGO) | 60 | 87% | 100% | 100% |
| Oligomers from T90 fraction of Heavy Catalytic Naphtha (HCN) | 180 | 100% | 100% | 100% |
| Oligomers from Heavy Coker Gas Oil (HKGO) | 180 | 100% | 100% | 100% |

The Arrhenius Parameters deduced from TGA data for HCN oligomers were $A=1.6\times10^{11}$ and Ea=40.0 kcal/mole. The Arrhenius Parameters deduced from TGA data for HKGO oligomers were $A=4.0\times10^{12}$ and Ea=42.3 kcal/mole. These A and Ea paramaters are lower than those typically associated with petroleum residua thermal cracking decomposition ($A=1\times10^{13}$, Ea=51 kcal/mole) and consistent with polymer unzipping (decomposition/cracking) kinetics. It is clear from the data that 30 minutes at 360° C. will eliminate these species from the feed. However, in these cases, in combination with a higher temperature coking process, 30 minutes or less would be sufficient.

Once the feed has undergone the heating described herein it is introduced into the reaction zone of the refinery unit. The reaction zone which is at about 530° C. causes further unzipping of oligomers and polymers at an unzipping rate about 30 to 50 times faster than in the preheat section before the reactor. Thus, since additional unzipping occurs in the reaction itself, shorter heating times are possible. Additionally, the average residence time of a coke particle in the reaction section is about 10 minutes, but since the residence time of some of the material in the reactor can be only about 10 to 25 seconds, the concern for making sticky coke is alleviated by the extension in thermal pretreatment time.

One skilled in the art will recognize that the heat-treated feed should not be allowed to cool and sit for extended times because re-oligomerization of the decomposition products that are soluble in the feed will take place.

One skilled in the art will recognize that the invention achieves a balance between heating the feed for a time and temperature sufficient to cause unzipping of polymeric and oligomeric materials while not overheating the feed in a manner that would form coke.

The heating described herein can be easily accomplished in a preheat zone of the refinery unit.

The following examples are meant to be illustrative and not limiting in any way.

EXAMPLE 1.

The following sample was carried out on a Vacuum Topped Bitumen (VTB) to which a polystyrene oligomer (PS) of about 25 units was added for illustrative purposes.

TABLE I

| Untreated (NO HEAT) | Viscosity at 80° C. (CPS) |
|---|---|
| VTB | 96,800 |
| VTB + 2% PS MW = 2500 | 96,800 |
| HEATED AT 360° C. for 3 hr | |
| VTB | 9,400 |
| VTB + 2% PS MW = 2500 | 4,500 |
| HEATED AT 360° C. for 0.5 hr | |
| VTB | 23,000 |
| VTB + 2% PS MW = 2500 | 15,600 |

The results show that polystyrene has no effect on the viscosity of untreated VTB. Heating for 3 hours at 360 decreased the viscosity of the VTB tenfold.

However, in the presence of 2 wt. % PS of MW=2500, the viscosity is cut in half again by heating. This indicates that if sticky oligomers are present in the feed, then a heat soak would be beneficial in shortening the sticky chains causing reduced stickiness. Also, the decomposition products of the polymer unzipping can provide additional solvent to further reduce the viscosity of the VTB. Since 3 hours is not a feasible time from a commercial perspective for heating the feed, the experiment was repeated for 0.5 hrs. Here, a fourfold decrease in viscosity vs. the unheat-treated case was observed, and again a further decrease to six-fold was observed in the presence of added PS.

The viscosities of the VTB feeds in Example 1 treated for 0.5 and 3 hours at 360° C. were remeasured after sitting in a sealed bottle for six months and the viscosities at 80° C. had increased to 120,000 and 31,500 CPS, respectively, due to re-oligomerization of the previously depolymerized molecules.

EXAMPLE 2.

The following example was carried out on a polystyrene oligomer (PS) of about 25 units with a vacuum resid (VR).

TABLE II

| Untreated (NO HEAT) | Viscosity at 80° C. (CPS) |
|---|---|
| VR | 5,740 |
| VR + 2% PS MW = 2500 | 4,100 |
| HEATED AT 360° C. for 3 hr | |
| VR | 1,640 |
| VR + 2% PS MW = 2500 | 1,640 |
| HEATED AT 360° C. for 0.5 hr | |
| VR | 2,460 |
| VR + 2% PS MW = 2500 | 2,005 |

The results in Table II illustrate that Polystyrene has only a small is effect on the viscosity of unheated VR. Heating for three hours at 360° C. decreased the viscosity of the vacuum resid three and one-half fold. However, in the presence of 2 wt. % PS of MW 2500 the viscosity was unchanged by heating indicating that in this case the 3-hr heating time unzipped all of the polymeric material present in this feed. This indicates that if sticky oligomers are present in the feed, then longer heat soak will be beneficial in shortening the sticky chains. Since 3 hours is not a feasible time from a commercial perspective for heating the feed, the experiment was repeated for 0.5 hrs. Here, a 2.3-fold decrease in viscosity vs. the unheat-treated case was observed and a further decrease to 2.8-fold was observed in the presence of added PS.

What is claimed is:

1. A process for decreasing fouling in refinery units wherein said refinery unit reactor zone is run at temperatures of at least about 300° C. and wherein a feed experiences heating in said refinery unit reaction zone, the process comprising pre-heating said feed to said refinery unit reactor zone and thereafter introducing said feed into said refinery unit reactor zone for reaction, wherein said feed contains polymers and oligomers, and wherein said feed is pre-heated for a time and at a temperature sufficient such that when said feed is introduced into said refinery unit reaction zone for reaction, the combination of said pre-heating and heating attributable to said reaction zone causes at least 85% of said polymers and oligomers contained in said feed to unzip and wherein no more than about 5 wt. % coke is formed in said feed during said preheating step.

2. In a refinery unit, where a feed is preheated and then introduced into said refinery unit reaction zone, and wherein said feed experiences heating in said refinery unit reaction zone, the improvement comprising pre-heating said feed to said refinery unit reactor zone and thereafter introducing said feed into said refinery unit reactor zone for reaction, wherein said feed contains polymers and oligomers, and wherein said feed is pre-heated for a time and at a temperature sufficient such that when said feed is introduced into said refinery unit reaction zone for reaction, the combination of said pre-heating and heating attributable to said reaction zone causes at least 85% of said polymers and oligomers contained in said feed to unzip and wherein no more than about 5 wt. % coke is formed in said feed during said preheating step.

3. The process of claim 1 wherein said feed is pre-heated at about 300 to about 400° C.

4. The process of claim 1 wherein said feed is pre-heated for a residence time of at least about 5 minutes.

5. The process of claim 1 wherein the viscosity of said feed is further reduced by said preheating step.

6. The process of claim 1 wherein said refinery unit is a cracking or coking unit.

7. The process of claim 1, wherein said feed is a vacuum topped bitumen or vacuum resid.

8. The process of claim 1 wherein said feed is a vacuum topped bitumen having a viscosity of about 96,000 CPS at 80° C. prior to the preheating and heating steps and a viscosity of about 15,600 CPS at 80° C. after being heated at about 360° C. for about 0.5 hours.

9. The process of claim 1, wherein said feed is a vacuum resid having a viscosity of about 4,100 CPS at 80° C. prior to the preheating and heating steps and a viscosity of about 2,000 CPS at 80° C. after being heated at about 360° C. for about 0.5 hours.

* * * * *